US008245623B2

(12) United States Patent
Weaver

(10) Patent No.: US 8,245,623 B2
(45) Date of Patent: Aug. 21, 2012

(54) WEAPONS SYSTEM AND TARGETING METHOD

(75) Inventor: Christopher S. Weaver, Binghamton, NY (US)

(73) Assignee: BAE Systems Controls Inc., Johnson City, NY (US)

( * ) Notice: Subject to any disclaimer, the term of this patent is extended or adjusted under 35 U.S.C. 154(b) by 140 days.

(21) Appl. No.: 12/962,259

(22) Filed: Dec. 7, 2010

(65) Prior Publication Data

US 2012/0145786 A1 Jun. 14, 2012

(51) Int. Cl.
*H01H 43/10* (2006.01)

(52) U.S. Cl. ..... 89/41.05; 89/41.14; 89/41.19; 89/200

(58) Field of Classification Search ..... 89/41.05, 89/41.14, 41.17, 41.19
See application file for complete search history.

(56) References Cited

U.S. PATENT DOCUMENTS 3,833,300 A 9/1974 Rymes
4,298,280 A * 11/1981 Harney ..... 356/5.06
4,302,666 A * 11/1981 Hawkins ..... 235/404
4,695,161 A * 9/1987 Reed ..... 356/254
5,026,158 A * 6/1991 Golubic ..... 356/252
5,331,881 A * 7/1994 Fowler et al. ..... 89/41.21
5,339,720 A * 8/1994 Pellarin et al. ..... 89/41.19
5,431,084 A * 7/1995 Fowler et al. ..... 89/41.21
5,684,481 A 11/1997 Ashe
5,726,747 A * 3/1998 Houlberg et al. ..... 356/139.04
5,760,887 A * 6/1998 Fink et al. ..... 356/5.03
5,825,480 A * 10/1998 Udagawa ..... 356/138
5,831,198 A * 11/1998 Turley et al. ..... 89/1.11
5,931,874 A * 8/1999 Ebert et al. ..... 701/1
5,974,940 A * 11/1999 Madni et al. ..... 89/41.17
5,988,645 A * 11/1999 Downing ..... 273/348
6,002,379 A * 12/1999 Udagawa ..... 345/9
6,172,747 B1 * 1/2001 Houlberg ..... 356/139.04
6,252,706 B1 * 6/2001 Kaladgew ..... 359/399
6,349,898 B1 * 2/2002 Leonard et al. ..... 244/3.15
6,499,382 B1 * 12/2002 Lougheed et al. ..... 89/41.05
6,899,539 B1 * 5/2005 Stallman et al. ..... 434/11
6,961,007 B2 * 11/2005 Ben-Ari et al. ..... 340/945
7,047,863 B2 * 5/2006 Hawkes et al. ..... 89/37.04
7,269,920 B2 * 9/2007 Staley, III ..... 42/114
7,404,268 B1 * 7/2008 Page ..... 42/137
7,495,198 B2 * 2/2009 Ari ..... 244/3.1
7,528,397 B2 5/2009 Boyer
7,806,331 B2 * 10/2010 Windauer et al. ..... 235/404
7,997,022 B2 * 8/2011 Morin et al. ..... 42/114
8,109,191 B1 * 2/2012 Rudakevych et al. ..... 89/28.05
8,172,139 B1 * 5/2012 McDonald et al. ..... 235/404
2003/0140775 A1 7/2003 Stewart (Continued)

*Primary Examiner* — Michelle Clement
(74) *Attorney, Agent, or Firm* — Scully, Scott, Murphy & Presser, P.C.

(57) ABSTRACT

A weapon system comprises a first, second and third sensor and a range detecting means. The weapon system further comprises a weapons platform removably mounted to a moveable vehicle. The weapons platform includes a gun. The first sensor is mechanically attached to the gun for sensing an image. The second sensor senses a position of the gun, including at least an elevation and azimuth. The third sensor detects a rate and altitude of the moveable vehicle. The range detecting means detects a range of the gun to the target. The weapon system also comprises an image processor for processing the image from the first sensor, a display for displaying the processed image and a controller. The controller calculates an expected impact point for a round of fire based upon the sensed and detected data, and superimposes the expected impact point on the processed image on the display.

19 Claims, 6 Drawing Sheets

U.S. PATENT DOCUMENTS

2004/0050240 A1* 3/2004 Greene et al. ..... 89/41.06
2005/0066808 A1 3/2005 Hawkes et al.
2006/0291849 A1 12/2006 Shamir et al.
2007/0051235 A1* 3/2007 Hawkes et al. ..... 89/37.04
2008/0048931 A1 2/2008 Ben-Ari
2008/0205700 A1 8/2008 Nir

* cited by examiner

WEAPONS SYSTEM AND TARGETING METHOD

FIELD OF THE INVENTION

This invention relates to a manned weapon system and targeting method for a manned weapon system.

BACKGROUND

Typical weapons systems are comprised of a weapon mounted onto a mount to a moving vehicle that allows the operator to slew the weapon in elevation and azimuth. These systems can be used to provide defensive suppression fire. Additionally, many of these systems, when employed from airborne platforms, can be used to provide close air support (CAS) where accuracy is extremely important due to the close proximity of friendly forces to enemy combatants.

A typical system is operated by a single gunner whom identifies and locates a threat through unaided vision. At night, this is accomplished usually using Night vision Goggles. However, the detection is limited to the range of the gunner's eyesight. At night the problem of identifying enemy targets is even greater due to the fact that enemy combatants are aware of the limitations with Night Vision Goggles.

Once the gunner identifies a threat, the gunner looking down the barrel of the weapon must compensate for the motion and speed of the moving vehicle when firing the weapon. This usually requires the gunner to fire bursts of ammunition from the weapon to "walk" tracers onto the target.

SUMMARY OF THE INVENTION

Accordingly, disclosed is a weapon system which allows a gunner to identify a threat at greater ranges, increases first round accuracy and improves lethality of the weapon.

Accordingly, disclosed is a weapon system for a movable vehicle. The weapon system includes a weapons platform with a gun. The weapons platform is attached to the moveable vehicle. The weapon system comprises a first, second and third sensor and a range detecting means. The first sensor is mechanically attached to the gun for sensing an image. The second sensor senses a position of the gun. The position of the gun includes at least an elevation and azimuth. The third sensor detects a rate and altitude of the moveable vehicle. The range detecting means detects a range of the gun to the target. The weapon system also comprises an image processor for processing the image from the first sensor, a display for displaying the processed image and a controller. The controller calculates an expected impact point for a round of fire based upon the position sensed by the second sensor, a relative distance to a target and the rate and altitude detected by the third sensor, and superimposes the expected impact point on the processed image on the display.

Additionally, the weapon system can comprise a global position device for determining a position of the moveable vehicle.

The moveable vehicle can be an aircraft such as a helicopter. Additionally, the moveable vehicle can be a gunboat.

The weapons platform can be attached to the moveable vehicle using a pintle mount. For example, the weapons platform can be pintle mounted to the door of a helicopter. The second sensor can be located in the pintle mount.

The first sensor can be a thermal sensor such as, but not limited to, an infrared image sensor. The infrared image sensor can include a step zoom which is used to estimate a relative distance to a target. Alternative, the range detecting means actively determines the relative distance or range from the weapons platform to a target.

The third sensor detects a rate for each direction of a three directional motion of the moveable vehicle.

The display can be a head mounted display or a head up display.

The controller displays the expected impact point relative to a target. The controller also determines a gun bore line based upon the sensed position of the gun and superimposes the gun bore line on the processed image. The gun bore line is displayed on the processed image using a first indicator and the expected impact point is displayed on the processed image using a second indicator. The second indicator is different than the first indicator.

Also disclosed is a method for locating a remote target using a weapons system having a manned weapon which is removably attached to a moveable vehicle. The method comprises the steps of sensing an image of a remote target using a first image sensor, processing the image from the first image sensor, displaying the processed image, sensing a position of the manned weapon, the position including elevation and azimuth, detecting a rate and altitude of a moveable vehicle, detecting a range of the manned weapon to the remote target; and calculating an expected impact point for a round of fire based upon the sensed position, a relative distance to a target and the rate and altitude, and displaying the expected impact point on a display by superimposing the expected impact point on the processed image.

The method further comprises the steps of determining a gun bore line based upon the sensed position of the manned weapon and superimposing the gun bore line on the processed image.

BRIEF DESCRIPTION OF THE FIGURES

These and other features, benefits, and advantages of the present invention will become apparent by reference to the following figures, with like reference numbers referring to like structures across the views, wherein.

DETAILED DESCRIPTION OF THE INVENTION

Figure 1:
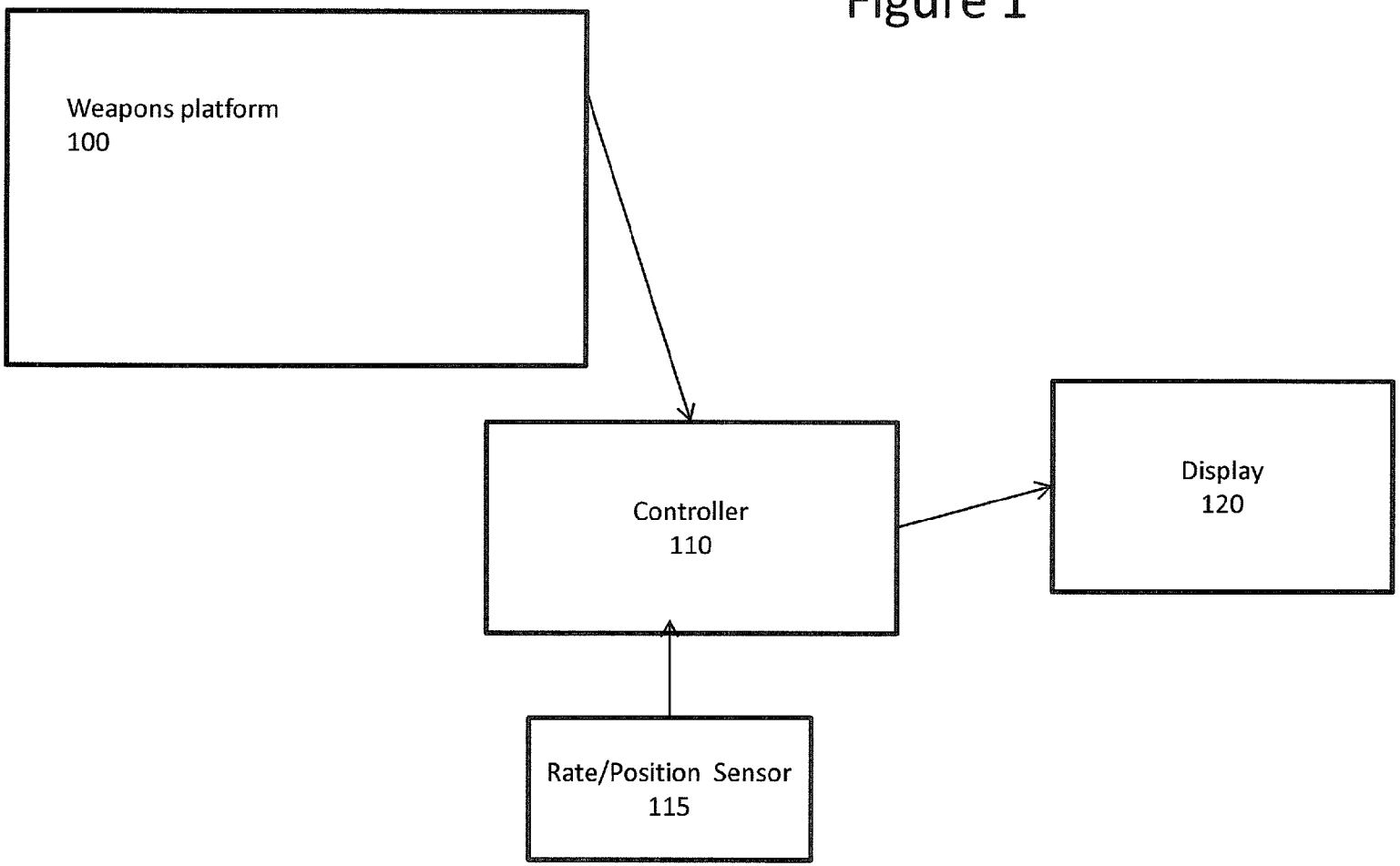
FIG. 1 illustrates a block diagram of the weapons system.

FIG. 1 depicts a weapons system 1 according to the invention. The weapons system 1 both detects an image and calculates an estimated or expected impact point for a round of fire or munitions and displays the image, an estimated or expected impact point and actual position of the weapon. Notably, the actual position of the weapon is superimposed over the image on a display using a first indicator. The estimated or expected impact point is superimposed over the image on the display using a second indicator. The weapons system 1 is adapted to be mounted or attached to a moving vehicle. The moving vehicle can be any land, air or water vehicle such as, but not limited to an ATV, tank, motorcycles, hovercraft, car, airplane, helicopter and ship.

Figure 2:
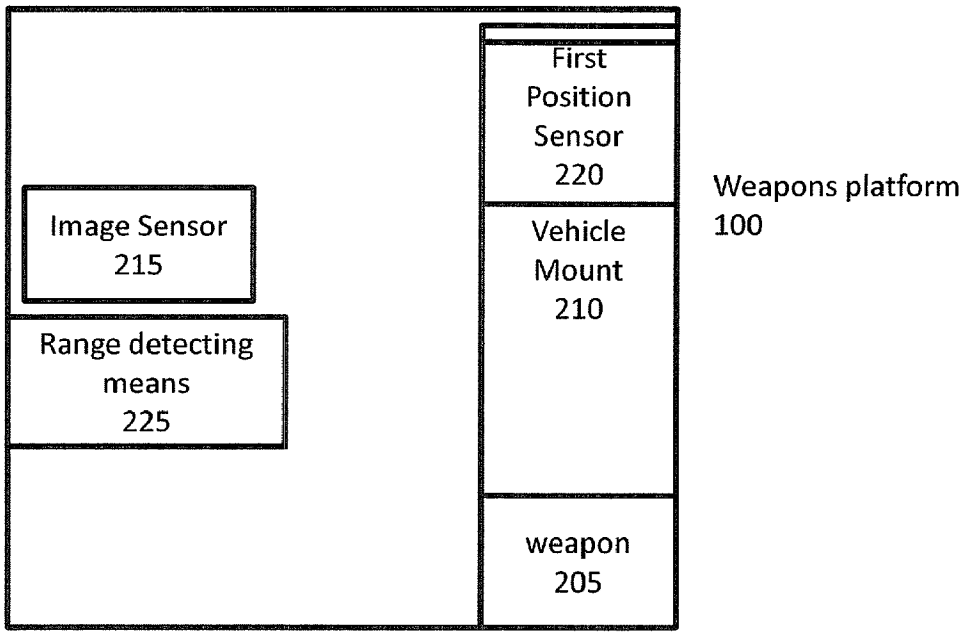
FIG. 2 illustrates a block diagram of the weapons platform.

The weapons system 1 includes a weapons platform 100, a controller 110, a rate/position sensor 115 and a display 120. The display 120 is responsive to signals from and controller 110. The weapons platform 100 contains weapon 205 and a vehicle mount 210, an image sensor 215, and a range detecting means 225 as depicted in FIG. 2, each of which will be described in further detail later.

The vehicle mount 210 includes a first position sensor 220 that senses an elevation and azimuth of the vehicle mount 210. The elevation and azimuth is used by the controller 110 to calculate the elevation and azimuth of the weapon 205. Alternatively, the controller 110 includes a list of offsets that can be added to the elevation and azimuth to get a more accurate position for the barrel of the weapon 205. The list can be stored as data in a storage device within the controller 110. The elevation and azimuth offset can vary based upon the type of weapon 205 and vehicle mount 210. The vehicle mount 210 will be described in more detail later with respect to FIG. 3.

As depicted in FIG. 1, the controller 110 is responsive to signals received from the image sensor 215, the first position sensor 220, range detecting means 225 and the rate/position sensor 115. The rate/position sensor 115 is located within the moving vehicle.

Figure 4:
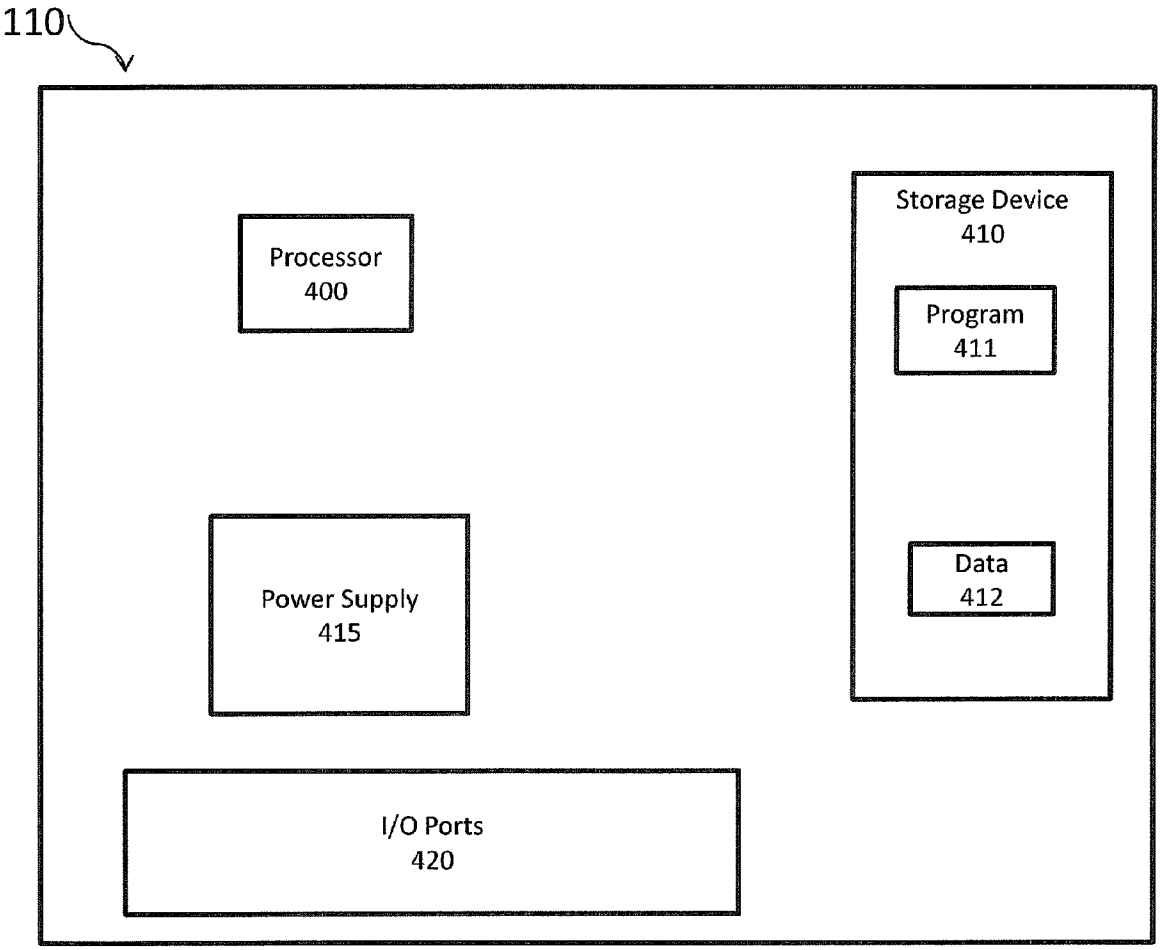
FIG. 4 illustrates a block diagram of the controller.

FIG. 4 illustrates a block diagram of the controller 110. The controller 110 includes a processor 400, a storage device 410, a power supply 415 and an input/output interface ("I/O Interface" 420. The I/O interface 420 is adapted to be connected to the sensors, e.g., image sensor 215, first position sensor 220, range detecting means 225 and rate/position sensor 115 (collectively "the sensors") and the display 120. The sensors can be connected to the I/O interface via a serial link. For example, the sensors can be connected to the I/O interface via a multiple pin single cable harness (not shown). Alternatively, each sensor can be connected to the controller 110 via a dedicated port assigned for each sensor. Similarly, the display 120 can be connected to the controller 110 using the multiple pin single cable harness attached to the I/O interface or via a dedicated port. The multiple pin single cable harness forms a communication path for electric signals from the sensors and display to the controller 110. Each sensor and the display 120 will be assigned pins for their respective signals. Additionally, each signal will include an identifier or header of the source. The communication path between the sensors and the controller 110 can be a bi-directional path. For example, the controller 110 can transmit sensor control signals, such as a zoom control signal to the image sensor 215 and the sensors can transmit signals representing the sensed data to the controller 110. Additionally, the controller 110 can provide power for the sensors. The controller 110 transmits image signals and display data to the display 120, where the display data is superimposed on the image. The display data includes a gun bore line and an estimated or expected impact point for munitions from the gun calculated and determined based upon the sensed data transmitted by the sensors to the controller 110.

Alternatively, the controller 110, the sensors and display 120 are wirelessly connected to each other. The wireless connection forms the communication path for signals from the sensors and the controller 110. The wireless signal would be transmitted as an encrypted wireless signal using wireless transmitter. The wireless connection is a secured connection and the signals transmitted will be encrypted using known encryption techniques which will not be described herein in detail.

The storage device 410 can be an optical, magnetic or solid-state memory device, including but not limited to, RAM, ROM, EEPROMS, flash devices, CD and DVD-media, HDD, permanent and temporary storage device and the like. As depicted in FIG. 4, the storage device 410 includes a program 411 that is executed by the processor 400 and data 412. The program 411 is executable by the processor 400 to perform the steps of the method(s) disclosed herein. The sensor data received by the controller 110 is stored in the storage device 410 as data 412. The data 412 also includes control parameters for the sensors.

The rate/position sensor 115 detects attitude, position and velocity of the moving vehicle. The rate/position sensor 115 can be an inertial measurement unit such as an onboard inertial sensor (gyros, accelerometer). Additionally, the rate/position sensor 115 can be a global position unit) receiving a GPS signal from GPS satellites. The position and orientation information is relative to a fixed coordinate system, e.g., yaw, pitch and roll.

The weapon system 1 detects a target and viewing area by means of an image sensor 215. The image sensor 215 is an infrared sensor. The image sensor 215 includes an infrared photodetector that senses radiation of objects in its field of view. The sensed radiation produces a voltage change in the infrared photodetector. This voltage is processed by an internal image processor. Alternatively, a separate image processor can be used. A video signal is sent to the controller 110.

The image sensor 215 is adapted to have a step zoom function. The step zoom function provides a control of a zoom factor. The step zoom function can be controlled by a user. A control button or switch can be included in the vehicle mount 210. Alternatively, the control button or switch can be included on the display 120. The zoom can be a digital zoom factor that is applied to the video signal. The factor can be used to estimate a range to a target and be used as the range detecting means 225. The controller 110 estimates the distance to the target using the zoom factor. When step zoom function is used to estimate the range to target, the controller 110 receives feedback from the image sensor 215 on the current zoom level of the image sensor 215. For image sensors 215 that use a digital zoom, the zoom factor feedback from the image sensor 215 is used. The zoom factor feedback is a digital signal received by the controller 110. The zoom factor feedback equates to the current field of view of the image sensor 215. The controller 110 is programmed with a look-up table that contains pre-determined range distances that correspond to the sensor zoom factors. The controller 100 converters the zoom factor feedback into a range to the target using the look-up table. This distance is used as range constants in the algorithm that computes expected impact point.

Alternatively, the range detecting means 225 is a separate range finding device. The range finding device can be any commercial available range detector. For example, an infrared laser range finder can be used. An infrared laser range finder includes a diode which emits an infrared signal towards the target. The target reflects the signal back towards the range finder. The time it takes for a roundtrip signal transmission/reflection is proportional to the distance a target is to the range finding device.

A video camera or radar sensor can also be used as the image sensor 215.

The image sensor 215 is adapted to be removably connected to the weapon 205. The weapon 205 includes a second connector which mates with the first connected to form the removable connection. For example, the first and second connectors can be a rail mount system, where the second connector forms a channel for attaching and locking a rail on the image sensor 200. Alternatively, the second connector can be a round aperture with a locking mechanism that forms a receptacle for a grooved extension from the image sensor 215 where the grooved extension from the sensing unit is placed in the round aperture and locked in place. The image sensor 215 is oriented in the same direction as the weapon 205.

The vehicle mount 210 includes a first position sensor 220 that senses the position and orientation of the vehicle mount 210 and gun 205. The first position sensor 220 can be any commercially available sensor that can detect position and orientation such as but not limited to gyros, electronic compasses, tilt sensors and transformers. The transformer type sensor can be either a rotary or linear variable differential sensor. The transformer would be attached to or embedded in the vehicle mount 210 and electrically coupled to an electromechanical transducer that provides a variable alternative current output voltage that is linearly proportional to the displacement. The controller 110 receives the voltage from the first position sensor 220, e.g., electromechanical transducer and transformer and calculates the weapon's position based upon the voltage reading.

The display 120 is a headset mounted in a helmet to be worn by an operator ("Helmet Display"). Alternatively, the display 120 can be a heads-up display ("HUD") located in the moving vehicle. For example, the HUD can be mounted on a wall surface of the moving vehicle.

The vehicle mount 210 can include a user interface that controls the weapon system 1, such as an on/off switch or button. Alternatively, the display 120 can include a user interface.

The processor 400 receives sensor data and determines the bearing of a round of ammunition relative to the line of sight to the target based upon a target range. The processor 400 uses the sensed position information from the first position sensor 210 to determine a pointing vector relative to a fixed coordinate system. For example, a geodetic coordinate system can be used. The sensed position information includes azimuth and elevation position data. This pointing vector is a gun bore line ("GBL"). The GBL is displayed on the display 120. The processor 400 also calculates a continuous expected impact point for a round of fire or munitions ("CCIP"). The processor 400 uses the position information, estimated (measured) range to target, vehicle rate/position information, ballistics constants, and environmental factors to estimate the expected impact point. The CCIP is displayed on the display 120.

Figure 3:
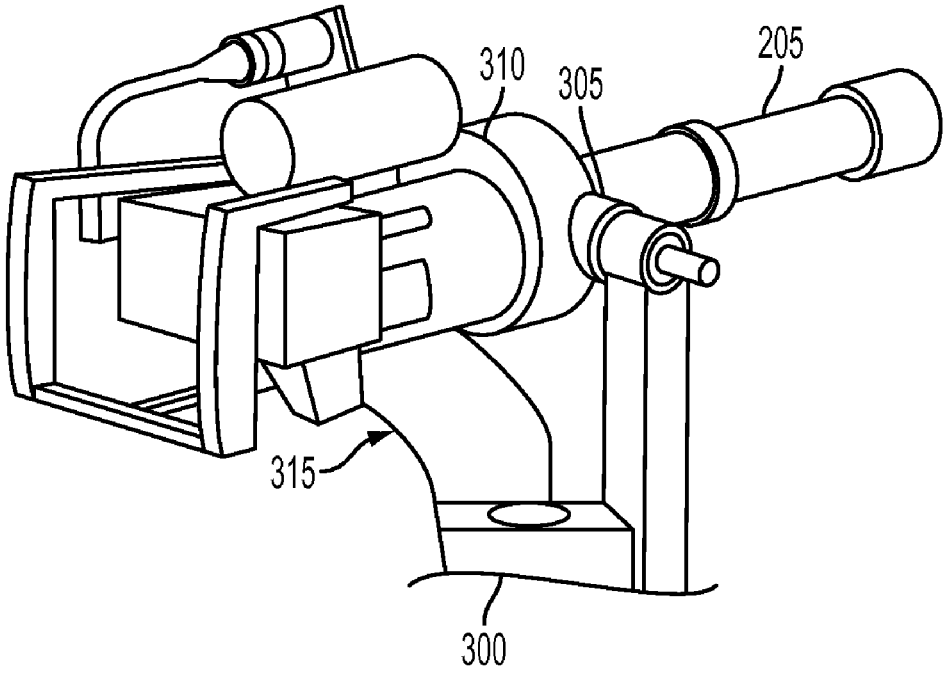
FIG. 3 illustrates the vehicle mount with a weapon.

As noted earlier, the weapon 205 is mounted to a moving vehicle using a vehicle mount 210. FIG. 3 illustrates an example of a vehicle mount 210. The vehicle mount 210 includes a base portion 300 adapted to be affixed to the moving vehicle, a moveable mechanical arm 305 adapted to allow a weapon 205 to be secured to the jaws of the arm 310 and a lower support member 315 adapted to support the weapon. The moveable mechanical arm 305 can change elevation and azimuth. The first position sensor(s) 220 can be located in the moveable mechanical arm 305 or any part of the vehicle mount 210 necessary to obtain the weapon azimuth and elevation.

Figure 5:
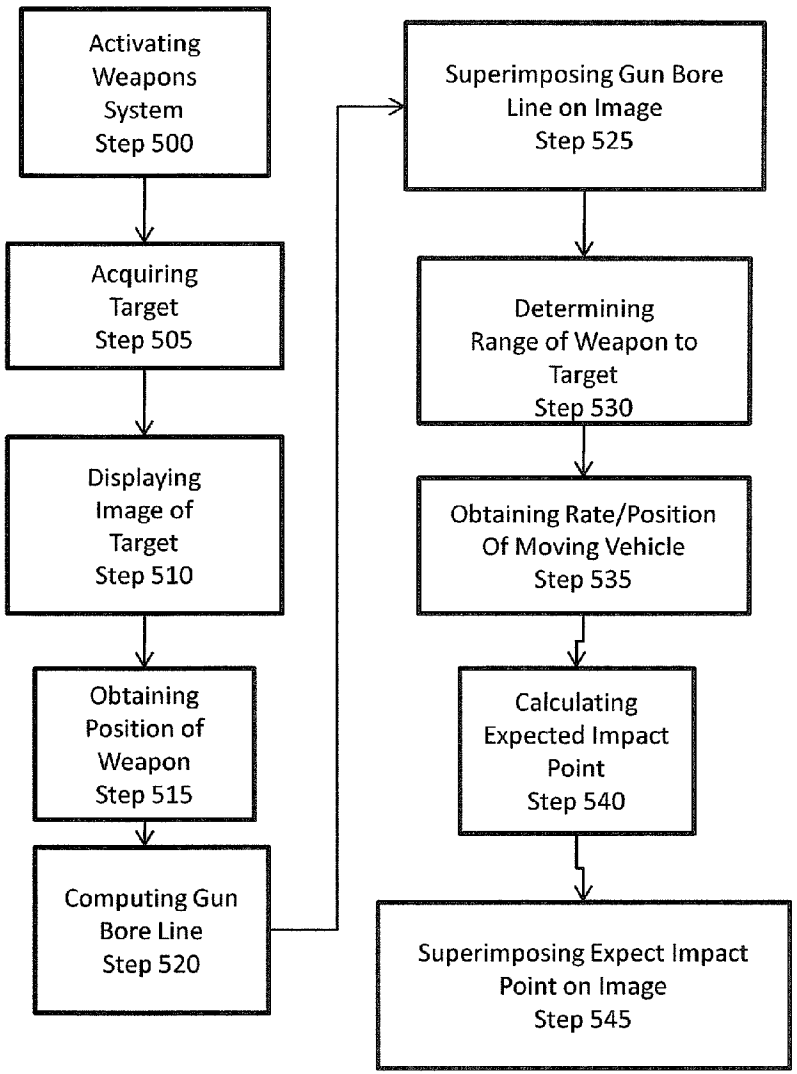
FIG. 5 illustrates a method for operating the weapons system.

FIG. 5 illustrates a flow chart for a method of operating the weapon system 1. At step 500, the gunner activates the weapons system 1 by turning the weapons system "on". The On/off switch or button can be located either on the controller 110, weapons platform 100 or on the display 120. When the weapons system 1 is "on", the controller 110 continuously monitors the image sensor 215, the first position sensor 220, the range detecting means 225 and the position/rate sensor 115 for input. The image sensor 215, first position sensor 220, range detecting means 225 and position/rate sensor 115 continuously sense or detect the image, position of the weapon 205, range to target and/or position/rate of the moving vehicle and output this information to the controller 110.

Once, the weapons system 1 is "on", the gunner manually acquires the target by moving the weapon 205. Since, the weapons system 1 is "on", a gunner's vision is aided by the image sensor 215, which allows a gunner to see a target at greater distance, even at night. Once the target is acquired, an image of the target is sensed and displayed on the display 120, at step 510. A signal representing the sensed target is transmitted to the controller 110 as a video signal. The processor 400, which can contain a graphics processor, processes and formats the video signal for display. The formatted video signal is output from the controller 110 and transmitted to the display 120.

At step 515, the position of the weapon 205 is determined. The controller 110 obtains the azimuth and elevation position data from the first position sensor 220. The controller 110 computes a gun bore line based upon the azimuth and elevation position data, at step 520. The controller 110 formats the computed gun bore line for display as a pointing vector. The formatting includes superimposing the gun bore line on the displayed target image. The superimposed gun bore line and target image is displayed on the display 120, at step 525. For example, the gun bore line can appear as a cross-hair. The computed gun bore line is also stored in storage 412.

At step 530, the controller 110 determines the range of the weapon 205 to the target. The controller 110 either receives a zoom factor feedback signal from the image sensor 215 or a signal from another range detecting means 225 to determine the range from the weapon 205 to the target. The controller 110 converters from received zoom factor feedback signal into a range. Additionally, at step 535, the controller 110 obtains position/rate data for the moving vehicle from the position rate/sensor. Each of the sensed information or data is used by the controller to calculate the expected impact point.

Figure 6:
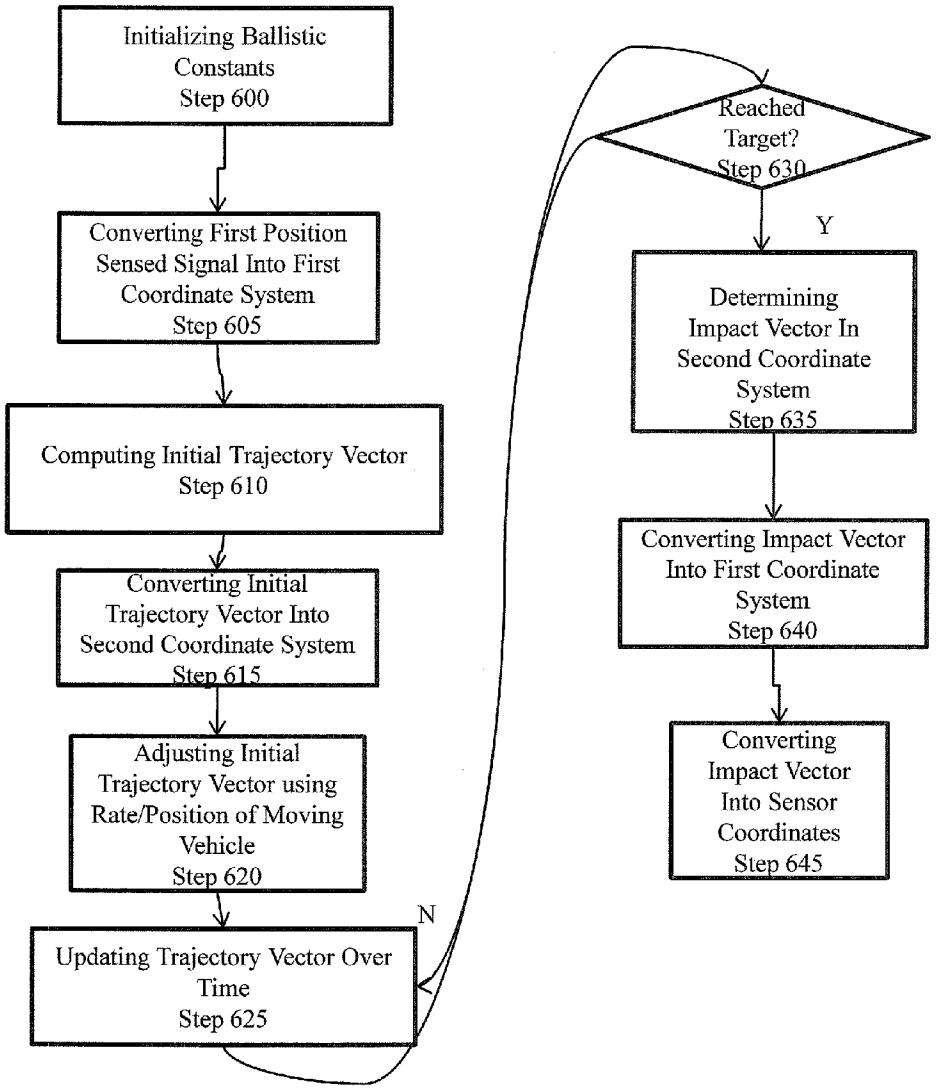
FIG. 6 illustrates a flow chart for calculating the CCIP.

At step 540, the controller 110 calculates a Continuously Computed Impact Point ("CCIP"), which represents the expected impact point of the round or ammunition. FIG. 6 illustrates a flow chart for calculating the CCIP. At step 600, the controller 110 initializes the ballistic constants, including, but not limited to, muzzle velocity and projectile spin. The controller 110 can include a look-up table that contains correspondence between a type of bullet and a ballistic constant used. This look-up table can also include a separate ballistic contract for type of weapon as well. The controller 110 will retrieve the ballistic constants for the type of weapon and ammunition. At step 605, the controller 110 converts the first position signal received from the first position sensor 220 into a first coordinate system using a conversion matrix. For example, for aircraft, an aircraft coordinate system will be used. The first position signal received from the first position system 220 is based on the sensor coordinate system. The relationship between the sensor coordinate system and the first coordinate system is apriori known. At step 610, the controller 110 compute an initial instantaneous trajectory vector using the converted first position signal as the direction. The magnitude of the trajectory vector, i.e., speed is set to an initial value based upon the ballistic constants for the type of weapon and ammunition. At step 615, controller 110 converts the initial trajectory vector into a second coordinate system using a second conversion matrix. For example, the second coordinate system can be an earth (geodetic) coordinate system. The relationship between the first and second coordinate systems is determined by vehicle attitude information (heading, pitch and roll) from the rate/position sensor 115.

At step 620, the initial trajectory vector is adjusted to account for the rate and position of the moving vehicle. The controller 110 obtains the rate/position information from the rate/position sensor 115. The speed (rate) and direction of the moving vehicle is added to the initial trajectory vector to adjust the vector and the adjusted initial trajectory vector is used as a starting point for a simulation of the flight of the bullet or ammunition to the target. The adjusted initial trajectory vector is continuously updated to account for aerodynamics until the position reaches the target, at step 625. In other words, the controller 110 simulates the path of the bullet over a distance (range) from the weapon 105 to the target, i.e., simulated range equals the estimated or measured range from the weapon to the target. The range is detected by the range detecting means 225. The simulation time is the time it takes for the bullet or ammunition to travel this range. For example, the simulation can be a time-based numerical integration of the ammunition. For each integration, a new position and speed is computed based upon the motion and path of the bullet or ammunition that accounts for aerodynamic forces acting on the projectile.

The controller 110 also can obtain information such as atmospheric density, wind vehicle airspeed, gravity, aerodynamic jump and propeller slipstream characteristics as applicable to accurately simulate the path or flight of the bullet or ammunition. Additionally, the projectile spin of the bullet (ballistic constants from above) is used to account for yaw repose specific for a type of bullet or ammunition. If atmospheric density is used, the density can either be estimated based upon the elevation of the moving vehicle and vehicle mount 210 or measured directly.

The controller 110 continuously determines if the simulated range is equal to the estimated or measured range from the weapon 205 to the target, at step 630. If the simulated range is less than the estimated or measured range from the weapon 205 to the target, step 625 is repeated. If the simulated range is equal to the estimated or measured range, step 625 is stopped and the last updated trajectory vector is assigned as the impact vector, at step 635. The impact vector represents the expected impact point in the second coordinate system. At step 640, the impact vector is converted from the second coordinate system to the first coordinate system. At step 645, the impact vector is converted from the first coordinate system into the sensor coordinate system for display.

At step 545, the expected impact point (converted impact vector) is displayed on the display 120. The controller 110 superimposes the expected impact point on the formatted video image signal and outputs the signal to the display 120. For example, the expected impact point can appear on the video image signal using a solid circle, or another variant of a cross hair symbol, indicating to the user the point of impact relative to the gun bore line, which is illustrated by a different indication. The controller 110, via the processor 400 can superimpose the symbols on the infrared image by using a graphics processing means capable of video input, capture and output. The processor 400 also contains an application programming interface such as, but not limited to, Open GL®, to draw the symbology and merge it with the captured video infrared image signal and transmit it as the new video output signal that will be viewed on the display 120.

As will be appreciated by one skilled in the art, the present invention may be embodied as a system, method or computer program product. Accordingly, the present invention may take the form of an entirely hardware embodiment, an entirely software embodiment (including firmware, resident software, micro-code, etc.) or an embodiment combining software and hardware aspects that may all generally be referred to herein as "system."

Various aspects of the present invention may be embodied as a program, software, or computer instructions embodied in a computer or machine usable or readable medium, which causes the computer or machine to perform the steps of the method(s) disclosed herein when executed on the computer, processor, and/or machine. A program storage device readable by a machine, tangibly embodying a program of instructions executable by the machine to perform various functionalities and methods described in the present disclosure is also provided.

The system and method of the present invention may be implemented and run on a general-purpose computer or special-purpose computer system. The computer system may be any type of known or will be known systems.

The above description provides illustrative examples and it should not be construed that the present invention is limited to these particular example. Thus, various changes and modifications may be effected by one skilled in the art without departing from the spirit or scope of the invention as defined in the appended claims.

What is claimed is:

1. A weapon system for a movable vehicle comprising:

a weapons platform including a gun, said weapons platform is attached to the moveable vehicle;

a first sensor mechanically attached to said gun for sensing an image;

an image processor for processing said image from said first sensor;

a display for displaying said processed image;

a second sensor for sensing a position of said gun, said position including elevation and azimuth;

a third sensor for detecting a rate and altitude of said moveable vehicle;

a range detecting means for detecting a range of the gun to said target; and a controller for calculating an expected impact point for a round of fire based upon the position sensed by said second sensor, a relative distance to a target and said rate and altitude detected by said third sensor, said expected impact point is superimposed on said processed image on said display.

2. The weapon system according to claim 1, wherein said moveable vehicle is a helicopter and said weapons platform is attached using a pintle mount to a helicopter door.

3. The weapon system according to claim 1, wherein said first sensor is a thermal sensor.

4. The weapon system according to claim 3, wherein said thermal sensor is an infrared image sensor.

5. The weapon system according to claim 1, wherein said expected impact point is displayed relative to a target.

6. The weapon system according to claim 1, wherein said display is a head mounted display.

7. The weapon system according to claim 1, wherein said display is a head up display.

8. The weapon system according to claim 1, wherein said range detecting means is an active relative distance detector for determining a range from said weapons platform to a target.

9. The weapon system according to claim 4, wherein said infrared image sensor includes a step zoom which is used to estimate a relative distance to a target.

10. The weapon system according to claim 1, further comprising a global position device for determining a position of said moveable vehicle.

11. The weapon system according to claim 1, wherein said third sensor detects a rate for each direction of a three directional motion of said moveable vehicle.

12. The weapon system according to claim 1, wherein said moveable vehicle is a gunboat.

13. The weapon system according to claim 2, wherein said pintle mount includes said second sensor.

14. The weapon system according to claim 1, wherein said controller determines a gun bore line based upon the sensed position of said gun and superimposes said gun bore line on said processed image.

15. The weapon system according to claim 14, wherein said gun bore line is displayed on said processed image using a first indicator and said expected impact point is displayed on said processed image using a second indicator, said second indicator being different than said first indicator.

16. A method for locating a remote target using a weapons system having a manned weapon which is removably attached to a moveable vehicle comprising the steps of:

sensing an image of a remote target using a first image sensor;

processing said image from said first image sensor;

displaying said processed image;

sensing a position of the manned weapon, said position including elevation and azimuth;

detecting a rate and altitude of a moveable vehicle;

detecting a range of said manned weapon to said remote target;

calculating an expected impact point for a round of fire based upon the sensed position, a relative distance to a target and said rate and altitude; and displaying said expected impact point on a display by superimposing said expected impact point on said processed image.

17. The method for locating a remote target using a weapons system having a manned weapon which is removably attached to a moveable vehicle according to claim 16, wherein said expected impact point is displayed relative to a target.

18. The method for locating a remote target using a weapons system having a manned weapon which is removably attached to a moveable vehicle according to claim 16, further comprising the steps of:

determining a gun bore line based upon said sensed position of said manned weapon; and superimposing said gun bore line on said processed image.

19. The method for locating a remote target using a weapons system having a manned weapon which is removably attached to a moveable vehicle according to claim 18, wherein said gun bore line is displayed on said processed image using a first indicator and said expected impact point is displayed on said processed image using a second indicator, said second indicator being different than said first indicator.

* * * * *